United States Patent [19]

Warner

[11] Patent Number: 5,040,339

[45] Date of Patent: Aug. 20, 1991

[54] DOUBLE DRUM POLISHER

[75] Inventor: Marvin P. Warner, Littleton, Colo.

[73] Assignee: Cyclo Manufacturing Company, Denver, Colo.

[21] Appl. No.: 543,669

[22] Filed: Jun. 25, 1990

[51] Int. Cl.[5] ..... B24B 23/00

[52] U.S. Cl. ..... 51/170 R; 51/170 PT

[58] Field of Search ..... 51/170 R, 170 PT, 174, 51/176, 180; 15/230, 230.11

[56] References Cited

U.S. PATENT DOCUMENTS

| | | | |
|---|---|---|---|
| 2,120,252 | 6/1938 | Kadri | 51/170 R |
| 4,102,083 | 7/1978 | Stern | 51/170 R |
| 4,499,624 | 2/1985 | Bloome et al. | 15/230 |

*Primary Examiner*—Maurina Rachuba

*Attorney, Agent, or Firm*—Gary M. Polumbus

[57] ABSTRACT

An apparatus for polishing surfaces includes an elongated handle having a mounting head on one end thereof that carries a pair of counter rotating polishing drums. The mounting head is rotatably mounted on the end of the handle to permit rotation of the polishing drums in unison for easily following a contoured surface. The handle of the apparatus is hollow with an exhaust vent at a remote location from the rotating heads so that high-pressure air that is delivered through a conduit in the hollow handle to the pneumatic motors driving the polishing drums can be exhausted through the hollow handle which muffles the sound and also allows lubricant fluids conventionally entrained in the high-pressure air to be removed at a remote location from the polishing drums.

7 Claims, 3 Drawing Sheets

DOUBLE DRUM POLISHER

BACKGROUND OF THE INVENTION

1. Field of the Invention

The present invention relates generally to powered polishing apparatus and more particularly to a powered polishing apparatus utilized in polishing large non-uniform surfaces such as the fuselage and wings of aircraft.

2. Description of the Prior Art

Power driven polishing apparatus have been available for numerous years due to the fact that hand polishing is very tedious, time consuming and depending upon the size of the surface being polished can be prohibitive merely from a human endurance standpoint. To remedy this practical problem, numerous power driven polishers have been developed for specific uses with some polishers utilizing a rotating disk having a circular polishing pad secured thereto while others have utilized a rotating drum having a cylindrical polishing pad thereon.

On large contoured surfaces such as found on the fuselage and wings of aircraft, the rotating drum type polisher has been found to be reasonably satisfactory. The rotating drum is typically air driven, i.e., mounted on pneumatic motors, and is positioned on the end of an elongated handle so that it can reach surfaces at a substantial distance from the individual operating the polisher. An example of a drum type polisher of the type typically used for polishing aircraft surfaces is shown in U.S. Pat. No. Des. 262,670 issued Jan. 19, 1982 to Martin Wellin. This type of polisher is typified by an elongated hollow handle through which high-pressure air is delivered to the inlet port of a pneumatic motor on which the rotating polishing pad is mounted and the exhaust from the pneumatic motor is immediately adjacent to the motor itself. Since lubricating fluids are frequently entrained in the high-pressure air to lubricate the motor, the same fluids are exhausted at a location immediately adjacent to the polishing pads as well as the surface on which the polishing work is being conducted. It will, therefore, be appreciated that undesired lubricating fluids will frequently get onto the polishing pads as well as the surface being polished creating a continuous need for changing the polishing pads and also deterring from efficient polishing of the surface.

Another drawback with prior art drum type polishers resides in the fact that they only have a single rotating drum which tends to pull itself across the surface being polished thereby requiring the operator to resist the movement which increases the required energy that is expended by the operator. In addition, due to the fact that the exhaust air is not muffled and is vented from the apparatus at a location immediately adjacent to the pneumatic motor, the polisher is relatively loud in operation.

As can be appreciated, the prior art, while providing systems for polishing large non-uniform surfaces, has not provided a system that is as efficient and acoustically desirable as is desired. It is to satisfy the shortcomings in the prior art systems that the present invention has been developed.

SUMMARY OF THE INVENTION

The polisher of the present invention is of the drum type having an elongated handle with a pair of counter rotating polishing drums mounted on a head that is itself rotatable relative to the handle. The handle includes a confined high-pressure air conduit for delivering high-pressure air to the mounting head in a unique manner to drive pneumatic motors carrying the two polishing drums. The handle also serves as an exhaust line so that air that is exhausted from the pneumatic motors can be vented at a location remote from the polishing drums.

Each pneumatic motor has an exhaust port which delivers the spent air through exhaust passages in the mounting head and subsequently through the hollow handle along a cylindrical passage surrounding the high-pressure conduit. The exhaust air is then vented to the ambient environment through a vent port near the end of the handle which is opposite the end on which the drums are mounted.

By venting the exhaust air at a remote location from the polishing drums, any lubricating fluids that are entrained with the high-pressure air to lubricate the pneumatic motors is prohibited from adversely affecting the polishing action or the polishing pads which would necessitate a frequent changing of the pads. In addition, the elongated handle serves to muffle the sound of the exhaust air rendering a relatively quiet operation. The rotatable mounting of the mounting head on the handle enables the two counter rotating polishing drums to follow almost any contoured surface so as to remain in contact therewith effecting a more thorough and efficient polishing of the surface.

Other aspects, features and details of the present invention can be more completely understood by reference to the following detailed description of a preferred embodiment, taken in conjunction with the drawings, and from the appended claims.

DESCRIPTION OF THE PREFERRED EMBODIMENT

Figure 1:
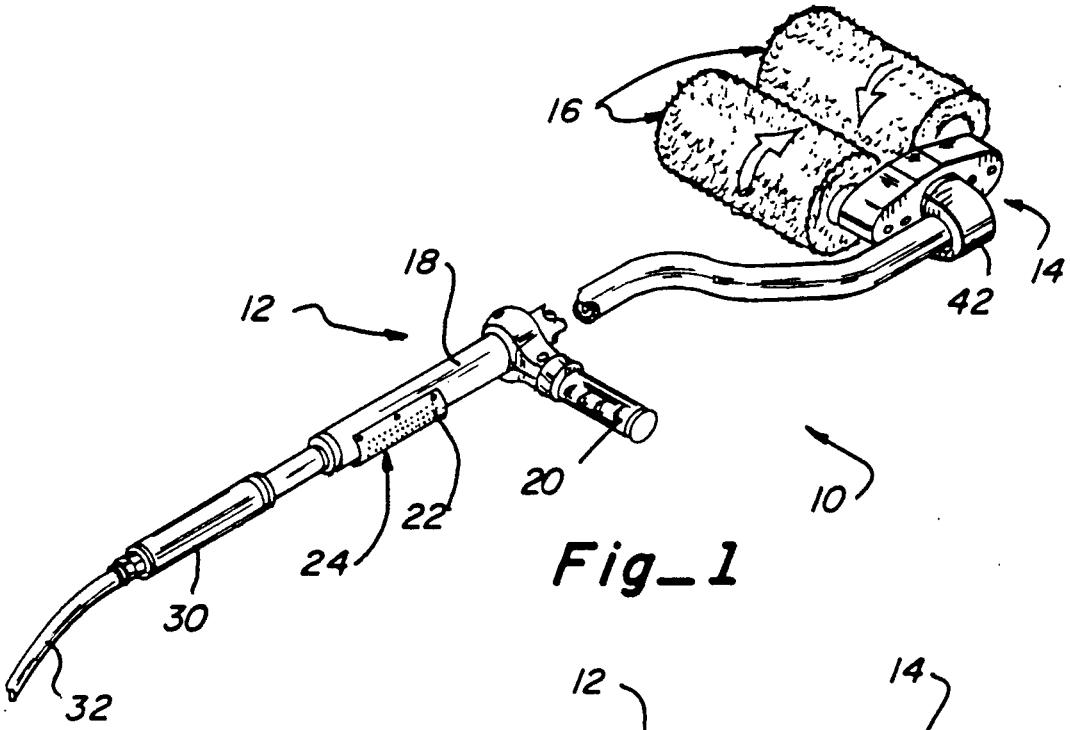
FIG. 1 is a perspective view of the polishing apparatus of the present invention with parts removed for size considerations.
Figure 2:
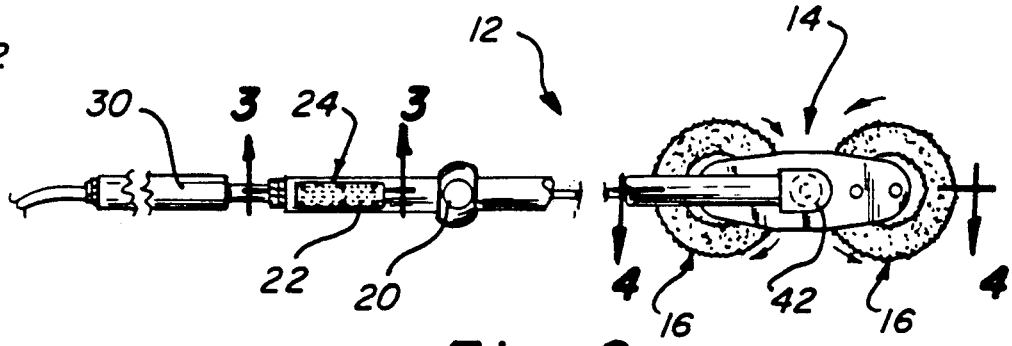
FIG. 2 is a side elevation of the apparatus shown in FIG. 1 with parts removed for size considerations.

Looking first at FIG. 1, the polishing apparatus 10 of the present invention can be seen to include an elongated handle 12 having a rotatable mounting head 14 at one end on which a pair of counter rotating polishing drums 16 are diametrically disposed. The rotatable mounting of the mounting head 14 on the end of the handle allows the counter rotating drums to pivot and rotate relative to the handle 12 as they are moved across a surface being polished.

Figure 3:
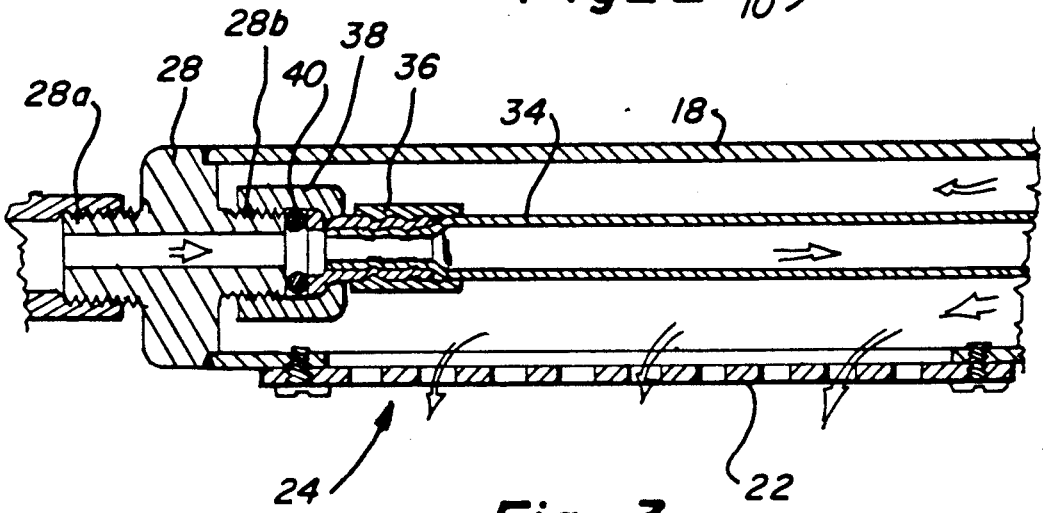
FIG. 3 is an enlarged fragmentary section taken along line 3—3 of FIG. 2.
Figure 4:
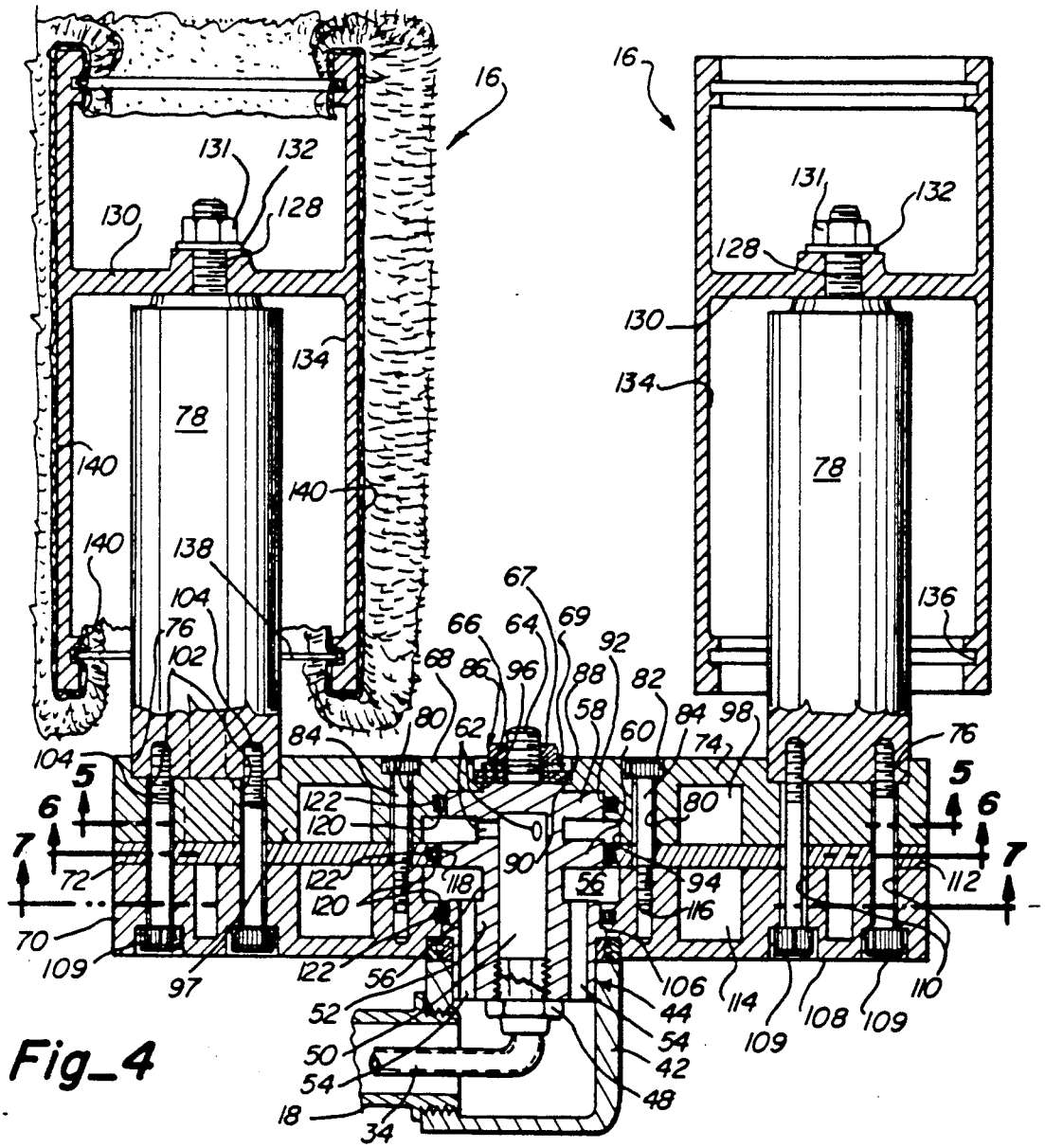
FIG. 4 is an enlarged section taken along line 4—4 of FIG. 2.
Figure 5:
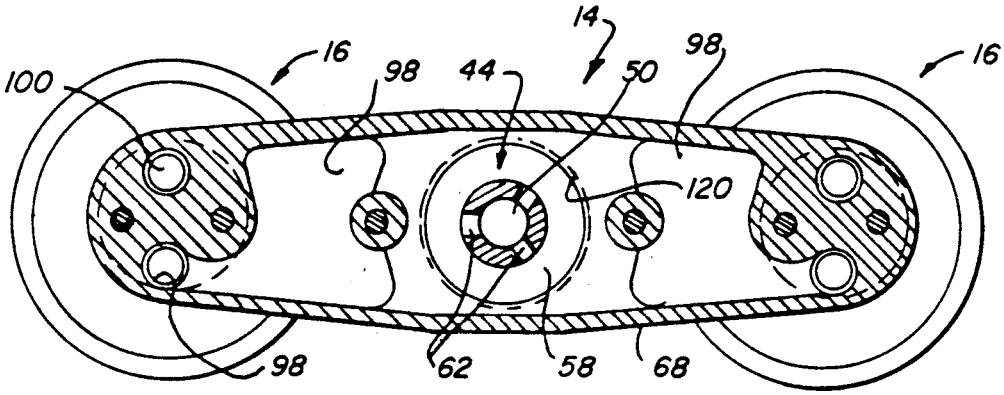
FIG. 5 is a section taken along line 5—5 of FIG. 4.
Figure 7:
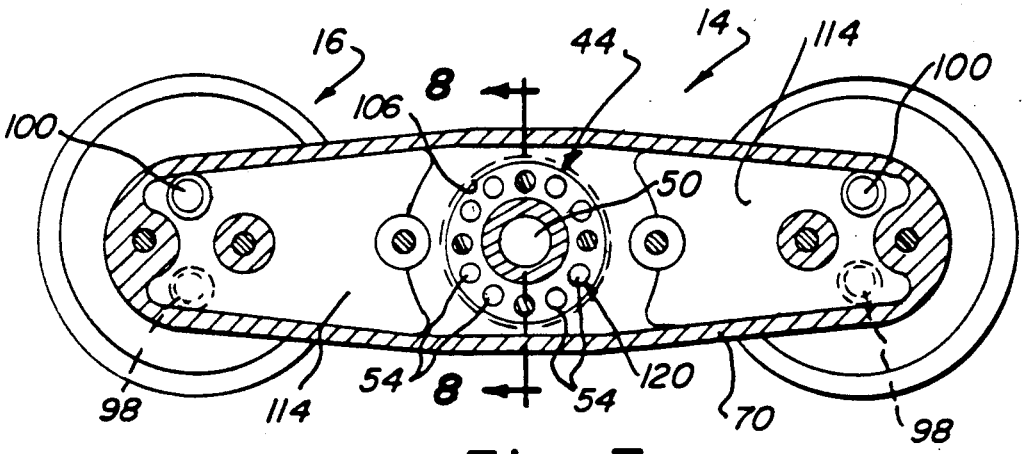
FIG. 7 is a section taken along line 7—7 of FIG. 4.
Figure 6:
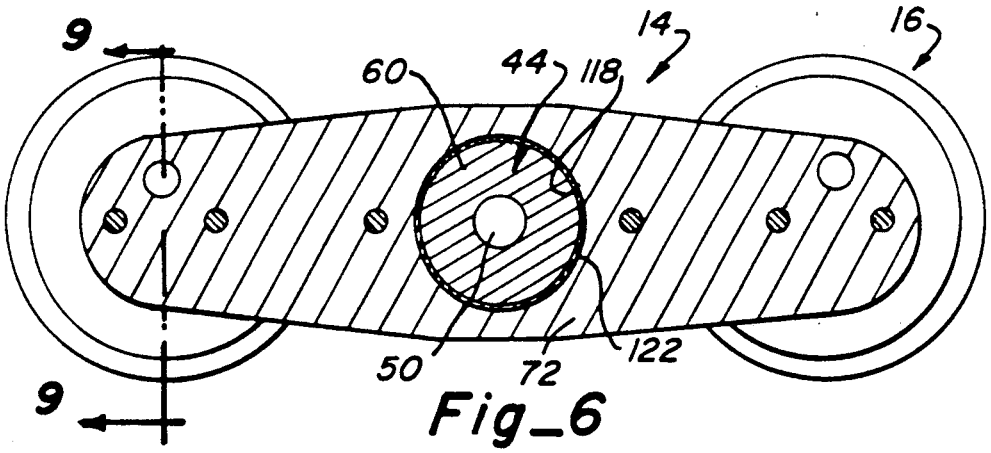
FIG. 6 is a section taken along line 6—6 of FIG. 4.

The elongated handle 12, as best seen in FIGS. 3 and 4, includes a hollow tubular body 18 that passes through a generally S-shaped curve at one end to accommodate the mounting head 14 and polishing drums 16. The opposite end of the handle is adapted for support by an operator of the apparatus and includes a laterally disposed grip 20 that is clamped or otherwise secured to the tubular body 18 to facilitate manipulation thereof. In other words, one hand can be placed on the grip 20 while the other is placed on the tubular body 18 to render the apparatus easily manageable. Adjacent the gripping end of the handle, a rectangular opening is provided with a perforated plate 22 thereacross that serves as a vent port 24 in a manner to be described in more detail later.

At the gripping end of the handle, a hollow connector 28 is welded or otherwise secured in the open end of the tubular body 18 and has threaded oppositely directed male axial connection arms 28*a* and 28*b*. The male connection arm 28*a* that protrudes outwardly of the tubular body 18 is adapted to receive a conventional air regulator valve connector 30 that is threaded onto the arm 28*a*. The air regulator valve connecter in turn conventionally receives a flexible high-pressure hose 32 so that high-pressure air can be delivered through the connector 30 with the air regulator valve permitting only unidirectional flow of air.

The inwardly directed axial arm 28*b* of the connector 28 receives one end of a high-pressure air conduit 34 which is sealed to the connector 28 through use of a crimp connector 36 and a threaded cap 38 which holds the end of the high-pressure air conduit against an O-ring 40 positioned on the end of the axial arm 28*b*. In this manner, the source of high-pressure air is connected to the high-pressure air conduit 34 in a sealed manner through the gripping end of the handle 12.

Figure 8:
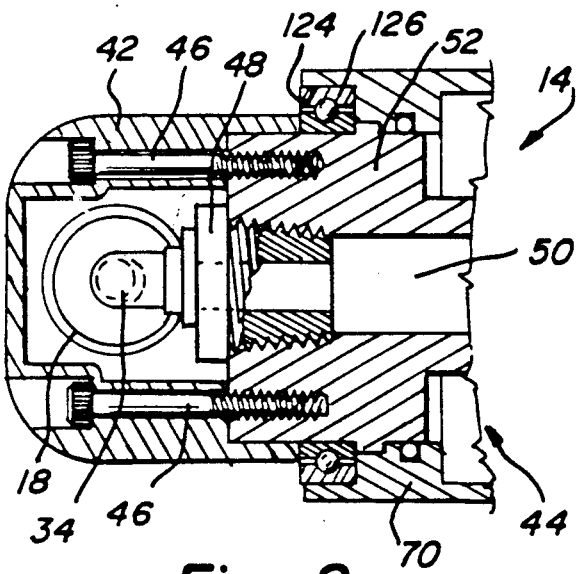
FIG. 8 is an enlarged section taken along line 8—8 of FIG. 7.
Figure 9:
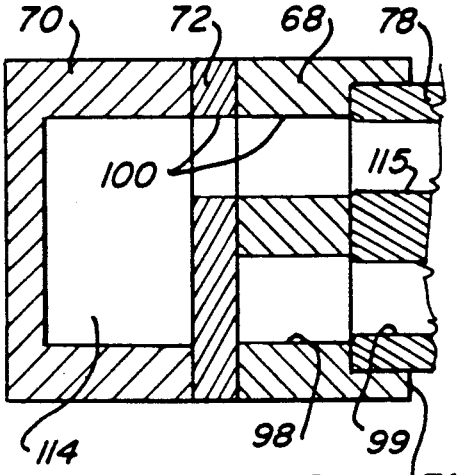
FIG. 9 is an enlarged section taken along line 9—9 of FIG. 6.

The opposite end of the handle, as seen in FIGS. 4 and 8, has the outer tubular body 18 threadedly connected to an elbow joint 42 which is anchored to a fixed hub 44 by a pair of anchor bolts 46. The hub, as will be described later, rotatably supports the mounting head 14. The high-pressure conduit 34 passes through a ninety degree bend and is secured to one axial end of the hub 44 by a threaded connector 48 that establishes communication between the high-pressure conduit and a central axial passage 50 in the hub. In this manner, the tubular body 18 and the high-pressure conduit 34 passing therethrough are fixed to the hub for unitary movement therewith.

The hub 44, as probably best seen in FIG. 4, is of generally cylindrical configuration having a main body 52 in which the central passage 50 is formed. The central passage opens through one end of the hub as do a plurality of axial outer circumferential passages 54 in the hub which surround the central passage 50. The outer circumferential passages communicate with a circular lateral exhaust opening 56 in the hub 44 which is positioned about midway along its length. A pair of axially spaced disk-like protrusions 58 and 60 are formed in the hub that extend perpendicularly to the longitudinal axis of the hub. A plurality of radially directed air holes 62 are formed in the hub between the disk-like protrusions 58 and 60 and communicate with the central passage 50 so as to define a path through which the high-pressure air can flow from the central passage into the mounting head 14 as will be explained more clearly later. The central passage 50 is closed at one end adjacent to the air holes 62 so that all air entering the central passage through the high-pressure conduit 34 is emitted through the air holes into the mounting head. The hub 44 also includes an integral axially extending threaded shaft 64 at the end opposite the connection to the handle 12 for receipt of a thrust bearing 66 that is held on by a nut 67 and washer 69. The thrust bearing 66 serves to retain the mounting head on the hub in a manner which will become more clear hereinafter.

As best seen in FIGS. 4–9, the mounting head 14 includes three generally planar members which are referred to as an outer high-pressure plate 68, an outer exhaust plate 70, and a separator plate 72 that is disposed therebetween. Each member is elongated in configuration so as to define two diametrically opposed radially extending arms on which the rotating polishing drums 16 are mounted.

The outer high-pressure plate 68 has an exposed surface 74 that includes cylindrical recessed seats 76 at diametrically opposite ends adapted to receive one end of conventional pneumatic motors 78. Closer to the center of the high-pressure plate 68 are a pair of diametrically opposed holes 80 having enlarged recesses 82 adapted to receive fastener bolts 84 for securing the three component members of the mounting head in a tightly compressed and sandwiched relationship. A hole 86 is provided through the center of the outer high-pressure plate to receive the hub 44 and the thrust bearing 66 mentioned previously. The hole 86 has four distinct portions of different diameters. Commencing at the exposed surface 74, a first diameter portion 88 is adapted to receive the thrust bearing 66. Immediately adjacent thereto is a second diameter portion 90 of smaller diameter than the first portion. The third and fourth portions 92 and 94 are progressively larger. A shoulder 96, defined between the first and second portions of the hole 86, has an outer surface against which the thrust bearing 66 reacts to hold the mounting head 14 on the hub 44.

The fourth portion 94 of the hole 86 is part of a high-pressure passage 98 which is contoured and formed as a recess in an enclosed face 97 of the high-pressure plate 68. The passage 98 is formed to communicate with the air holes 62 in the hub 44 which in turn communicate with the central passage 50 of the hub. The passage 98 opens into a selected spot in each recessed seat 76 at opposite ends of each arm so as to establish communication between the high-pressure passage 98 and a high-pressure input 99 to the associated pneumatic motor 78. Exhaust ports 100 also extend through the high-pressure plate 68 into the seats 76, but are not in communication with the high-pressure passage 98. The exhaust ports 100 further extend through the separator plate 72 as will be explained later. Holes 102 are also provided through the high-pressure plate 68 into the seats 76 to receive anchor bolts 104 that hold the pneumatic motors to the outer high-pressure plate.

The outer exhaust plate 70 is designed similarly to the outer high-pressure plate 68 in that it has a central opening 106 for receiving the hub 44. The exposed surface 108 of the exhaust plate is recessed at four locations 109 to receive the heads of the anchor bolts 104 and passages 110 are provided through the outer exhaust plate in alignment with the holes 102 in the high-pressure plate to receive the shanks of the anchor bolts 104. The opposite or enclosed face 112 of the exhaust plate has a contoured recessed exhaust passage 114 that establishes communication between the outer circumferential passages 54 in the hub 44 and the exhaust ports 100 that extend through the high-pressure plate 68 and the separator plate 72 into communication with the exhaust outlet 115 of the associated pneumatic motor 78. In this manner, the exhaust or spent air that emanates from the pneumatic motors passes through the associated exhaust ports 100 and the exhaust passage 114 before subsequently being removed through the outer circumferential passages 54 where it is allowed to pass through the hollow tubular body 18 of the handle 12. The enclosed face 112 of the outer exhaust plate 70 also has a pair of internally threaded holes 116 adapted to receive the fastener bolts 84 that hold the three component members of the mounting head together.

The separator plate 72 is a relatively thin, solid plate member that is positioned between the outer high-pressure plate 68 and the outer exhaust plate 70 so as to close off the contoured passages 98 and 114 provided in the enclosed faces of the outer plates so that they are distinct and separate from each other. The separator plate 72 has appropriate openings passing therethrough for receipt of the anchor bolts 104 that hold the pneumatic motors to the mounting head and the fastener bolts 84 which hold the three component members of the mounting head together. The separator plate also has a relatively large centrally disposed opening 118 for receipt of the hub 44 with this opening being alignable with the second disk like protrusion 60 on the hub. Circumferential recesses 120 are provided in the central opening of the high-pressure plate, the separator plate and the outer exhaust plate to receive O-ring seals 122 which establish a rotating seal between the hub 44 and the three plate members of the mounting head.

A circumferential recess 124 is provided in the exposed surface 108 of the exhaust plate 70 around the central opening 106 to receive the outer race of a bearing 126 that has its inner race press fitted on the hub 44. The outer race is press fitted in the recess 124 to establish a freely rotatable relationship between the hub and the mounting head.

It will be appreciated that even during relative rotation between the mounting head 14 and the hub 44, the outer circumferential passages 54 of the hub remain in air communication with the exhaust passage 114 through the exhaust plate 70, and the central passage 50 of the hub remains in air communication with the high-pressure air passage 98 through the high-pressure plate 68. In this manner, high-pressure air delivered through the high-pressure conduit 34 into the central passage 50 of the hub is dispersed into the high-pressure air passage 98 via the air holes 62 for delivery to the pneumatic motors 78 through the high-pressure ports. Conversely, air that is exhausted from the pneumatic motors can pass through the exhaust ports 100 and into the exhaust passage 114 in the exhaust plate 70 and subsequently through the outer circumferential passages 54 in the hub for delivery to the hollow main body 18 of the handle 12 wherefrom the air passes in a reverse direction to the high-pressure air for venting through the vent port 24 at the opposite end of the handle.

As mentioned previously, the pneumatic motors are conventional having an output shaft 128 at the end thereof that is remote from the mounting head 14. The output shaft is rotated by the associated motor and is connected to a cross frame member 130 of the polishing drum 16 by a nut 131 and washer 132. The cross frame member 130 supports a rigid cylindrical drum body 134 having circumferential recesses 136 provided at opposite ends thereof for receipt of C-type ring clamps 138. In this manner, cylindrical polishing pads 140 can be disposed about the exterior of the cylindrical drum body 134 with the opposite ends of the pads 140 held in position by the C-type clamps that are engageable in the circumferential recesses 136.

While the motors 78 could be mounted for rotation in any desired direction, it has been found that counter rotation of the polishing drums 16 achieves a number of desirable results. By placing the side of the drums that are rotating toward each other adjacent the surface to be polished, the polishing compound is thrown inwardly toward the opposite drum for better utilization of the polishing compound. Further, the counter rotating relationship of the drums serves to prevent the polisher from walking across the surface so that the operator does not have to fight or resist the tendency of the drums to move across the surface being polished.

An important feature of the present invention resides in the fact that the vent port 24 for the apparatus is provided at the operator end of the handle 12 so as to be remote from the mounting head 14 and the polishing drums 16 mounted thereon. This accomplishes several desirable results in that the passage of the exhaust air through the elongated handle serves to muffle the sound so that the apparatus is more quiet in operation than prior art systems. It is also typical to entrain lubricating fluid in the high-pressure air that drives the pneumatic motors and by venting the air at a remote location from the polishing drums, the lubricating fluid is not allowed to be deposited on the surface being polished or to contaminate the polishing pads which would otherwise necessitate frequent changing of the pads. Although the present invention has been described with a certain degree of particularity, it is understood that the present disclosure has been made by way of example, and changes in detail or structure may be made without departing from the spirit of the invention, as defined in the appended claims.

I claim:

1. An apparatus for polishing surfaces comprising in combination:

an elongated handle, a mounting head rotatably disposed on one end of said handle, including a pair of radially extending arms and a pair of pneumatic motors mounted on said arms, said mounting head including a high pressure air supply passage and an exhaust passage, a pair of polishing pads rotatably mounted on said mounting head and wherein said pads are rotated by said motors, supply means for delivering a source of power to rotate said polishing pads, said supply means including a high-pressure line that includes a high-pressure passage as part thereof and an exhaust line that includes the exhaust passage as part thereof, said high pressure line and exhaust line being in operative communication with said motors for driving the motors in preselected directions, and a central hub rotatably interconnecting the handle with the mounting head and wherein the radially extending arms are rotatably mounted in said hub and the motors are mounted on said radially extending arms, said hub further including a central passage forming a part of said high-pressure supply line, said central passage being in continuous communication with said high-pressure air supply passage.

2. The apparatus of claim 1 wherein said central hub includes an outer passage forming a part of said exhaust line, said outer passage being in continuous communication with said hollow tube and the exhaust passage.

3. The apparatus of claim 2 wherein said radially extending arms are integral with each other.

4. The apparatus of claim 3 wherein said radially extending arms are formed from first and second outer plate members and a separator plate member with the separator plate member being sandwiched between said first and second outer plate members.

5. The apparatus of claim 4 wherein said high-pressure air supply passage is defined by a recessed area in one face of said first outer plate member and said exhaust passage is defined by a recessed area in one face of said second outer plate member and wherein said recessed areas are enclosed by abutment of said one face of each of said first and second outer plate members against opposite faces of said separator plate member.

6. The apparatus of claim 1 wherein said hub includes at least one radial passage establishing communication between said central passage and said high-pressure air supply passage.

7. An apparatus for polishing surfaces comprising in combination:

an elongated hollow handle, an exhaust port formed in said handle near a first end thereof, a high-pressure tubular conduit extending through said handle and having means at a first and thereof for connecting the conduit to a supply of high-pressure air, said first end of said handle being adjacent to the first end of said conduit, a central hub positioned on a second end of said handle, said central hub having a central passage in sealed communication with said high-pressure tubular conduit, an outer circumferential passage in communication with said hollow handle and the exhaust port, and a plurality of radial passages communicating with said central passage, and a mounting head having a pair of diametrically opposite radially extending arms, a high-pressure air passage in communication with said central passage of the hub through said radial passages and an exhaust passage in communication with said outer circumferential passage of the hub, and a pair of pneumatic motors mounted one on each of said diametrically opposite arms, said motors having polishing pads mounted thereon for rotation by said motors and being in communication with said high-pressure air passage and said exhaust passage whereby high-pressure air delivered to said motors through said conduit, central passage and high-pressure air passage can be exhausted from the motors through said éxhaust passage, outer circumferential passage, tubular handle and exhaust port.

* * * * *